US009533231B2

(12) United States Patent
Peres et al.

(10) Patent No.: US 9,533,231 B2
(45) Date of Patent: Jan. 3, 2017

(54) SWING SEAT

(71) Applicant: Playpower, Inc., Huntersville, NC (US)

(72) Inventors: Jonas Peres, Vasteras (SE); Marcus Soderstrom, Huskvarna (SE)

(73) Assignee: PLAYPOWER, INC., Huntersville, NC (US)

( * ) Notice: Subject to any disclaimer, the term of this patent is extended or adjusted under 35 U.S.C. 154(b) by 0 days.

(21) Appl. No.: 14/919,415

(22) Filed: Oct. 21, 2015

(65) Prior Publication Data

US 2016/0121226 A1 May 5, 2016

(30) Foreign Application Priority Data

Nov. 4, 2014 (EP) ..... 14191681

(51) Int. Cl.

*A63G 9/02* (2006.01)
*A63G 9/00* (2006.01)
*A47D 13/00* (2006.01)

(52) U.S. Cl.

CPC .. *A63G 9/02* (2013.01); *A63G 9/00* (2013.01)

(58) Field of Classification Search

CPC ..... A63G 9/00; A63G 9/02; A63G 9/16; A63G 9/20; A47D 13/00; A47D 13/10; A47D 13/105
USPC ..... 472/118, 120–125; 297/245
See application file for complete search history.

(56) References Cited

U.S. PATENT DOCUMENTS 198,091 A * 12/1877 Eller ..... A47D 13/10 472/123
317,028 A 5/1885 Shields
1,196,375 A * 8/1916 Medart ..... A63G 9/16 472/122
D76,611 S * 10/1928 Ferris ..... 472/118
1,886,904 A 11/1932 Rice
2,358,098 A 9/1944 Pippin
2,497,372 A 2/1950 Pricer
2,516,975 A * 8/1950 Gazella ..... A63G 9/02 472/120
2,524,967 A 10/1950 Ellis
(Continued)

FOREIGN PATENT DOCUMENTS

CA 2398797 A1 6/2003
CN 201157674 Y 12/2008
(Continued)

OTHER PUBLICATIONS

ESSR for Corresponding EP Appl, No. 14191681.7 dated Apr. 24, 2015.

*Primary Examiner* — Kien Nguyen

(74) *Attorney, Agent, or Firm* — Polster Lieder Woodruff & Lucchesi, L.C.

(57) ABSTRACT

A swing seat for increased capacity wherein swing extends along a longitudinal axis and the swing seat comprises a first seat portion and a second seat portion coupled to the first seat portion. The first seat portion is a safety seat having a base portion for seating a child and a support frame for supporting a child in an upright position, and the first seat portion is arranged to swing in a general swinging direction substantially coinciding with the longitudinal axis. The second seat portion is arranged in line with the first seat portion along the longitudinal axis so that the first and second seat portions are both aligned to swing together in the general swinging direction.

18 Claims, 4 Drawing Sheets

(56) References Cited

U.S. PATENT DOCUMENTS

| | | | | | |
|---|---|---|---|---|---|
| 2,533,482 | A | * | 12/1950 | Liesner | A63G 9/20 297/244 |
| 3,663,016 | A | | 5/1972 | Morris | |
| 3,918,709 | A | | 11/1975 | Bishop | |
| 4,256,300 | A | | 3/1981 | Boucher | |
| 4,417,725 | A | | 11/1983 | Van Horn | |
| 4,570,928 | A | | 2/1986 | Smith | |
| 4,699,423 | A | | 10/1987 | Fitzig et al. | |
| D341,948 | S | | 12/1993 | Nolan | |
| 5,334,099 | A | * | 8/1994 | Marra | A47D 13/105 24/650 |
| 5,344,212 | A | | 9/1994 | Muller et al. | |
| 5,393,268 | A | | 2/1995 | Cunard et al. | |
| 5,875,779 | A | | 3/1999 | Fuhrman et al. | |
| 6,482,096 | B1 | | 11/2002 | Rieber et al. | |
| 6,994,631 | B1 | * | 2/2006 | Habing | A47C 3/0255 297/245 |
| 7,300,355 | B1 | | 11/2007 | Hense | |
| 7,419,437 | B2 | | 9/2008 | Boll et al. | |
| D591,004 | S | | 4/2009 | Rickman | |
| 9,084,940 | B2 | | 7/2015 | Norquist et al. | |
| 2005/0107173 | A1 | | 5/2005 | Pelletier | |
| 2009/0131184 | A1 | | 5/2009 | Pizmony | |
| 2011/0045917 | A1 | | 2/2011 | Morris | |

FOREIGN PATENT DOCUMENTS

| | | | |
|---|---|---|---|
| DE | 22918681 | U1 | 1/2000 |
| EP | 2067510 | A1 | 10/2009 |

* cited by examiner

SWING SEAT

CROSS-REFERENCE TO RELATED APPLICATIONS

This application claims priority to European App. No. 14191681 filed Nov. 4, 2014, entitled "Generation Swing Seat" and which is incorporated herein by reference.

TECHNICAL FIELD OF THE INVENTION

The present invention relates to a swing seat for a playground swing.

BACKGROUND

In playgrounds there are often several play elements, such as playground swings, which usually are a popular attraction in the playground. Commonly, the swing is arranged hanging from a structure by, for instance, a chain or wire. In most cases a swing comprises one seat, which allows one child to swing. This may be a problem, since a swing set is rather big and in many cases the number of swings cannot satisfy the need for the number of children who want to play with the swings. Also, many of the smaller children need a parent's attention which can make it even more crowded in the swing area. This problem is partly solved by the swing presented in EP2067510, in which a swing is provided with two or more seats next to each other (i.e., side by side). With this solution two or three children may swing sitting next to each other. However, there is always a need for increasing the capacity of the swings at a playground.

SUMMARY

In view of the above mentioned and other drawbacks of the prior art, we proposed to provide a swing seat that alleviates at least the capacity problems mentioned above.

The disclosed swing seat is based on the inventors' realization that a swing seat having two or more seats placed next to each other is space consuming, and they have therefore designed a combined swing seat which allows infants or small children to swing together with, for instance, a parent in a common swinging axis and simultaneously admitting eye contact between the child and the parent.

According to a first aspect of the swing seat, the swing seat extends along a longitudinal axis. The swing seat comprises a first seat portion and a second seat portion substantially rigidly coupled to the first seat portion, such that the distance between the first and second seat portions remains substantially fixed during use of the swing seat. The first seat portion can be a safety seat having a base portion for seating a child and a support frame for supporting a child in an upright position, and the first seat portion is arranged to swing in a general swinging direction substantially coinciding with the longitudinal axis. The second seat portion is arranged in line with the first seat portion along the longitudinal axis so that the first and second seat portions are both aligned to swing in the general swinging direction.

Since a regular single swing commonly only seats one user at a time, it is an advantage to provide a swing seat with more than one seat portion. The seat portions may be arranged along a longitudinal axis of the swing seat, and arranged so that the general swinging direction aligns with the longitudinal axis. This means that the seats may be arranged one in front of the other (i.e., in tandem). Further, having a swing seat having at least two seat portions arranged in line with each other so that the seat portions are arranged along a longitudinal axis, front-to-front, a small child and, for instance, a sibling or a parent may swing together. This is an advantage, since the swing seat enables the parent to see and hold the child during swinging.

By "young child" it is meant a child who needs extra support when sitting on a swing, such as an infant or a toddler, or a child of the size that it fits into a safety seat. A bigger child may be able to sit on a swing without extra support but may nevertheless use a safety seat if required.

One seat is a safety seat, meaning that the seat is adapted to suit a young child that needs extra support to be held in an upright position. The safety seat may comprise a base portion, arranged to seat a child. The support frame may comprise a waist frame that surrounds the child around the child's waist and upper body. It may alternatively be a partial frame that supports a part of the upper body, for instance the back and sides. The seat portion may be arranged to seat the child. The support frame may comprise a mid-section that at least partially extends from the base portion towards the waist frame, and is arranged in the front part of the seat. The support frame may further comprise a back support that at least partially extends from the base portion towards the support frame at the back part of the seat portion, and thus may be configured to support the child's back when the child is seated. The child seat may have suitable spaces to place the child's legs, which may be configured such that the legs may be placed on each side or in front of the mid-section. The second seat portion may be placed in front of, or behind, the first seat portion. Further, with a swing seat having two or more seat portions in line with each other, valuable space on the playground swing set may be made available for several other swings, allowing more children to enjoy the swings. There is also an alternative that both seat portions comprise safety seats so that two infants or small children may be swung simultaneously. This solution may be advantageous for parents having twins, which allow them to swing both children at the same time having instant supervision of both children.

According to an embodiment of the swing seat, the first and second seat portions may be arranged so that when in use, users of the first and second seats are facing each other.

By having the seat portions placed so that the users sit face to face, it may allow a parent to have instant control over a child to share an enjoyable moment together with the child, which is an advantage since parents are encouraged to actively interact with their children. Also, a swing seat of this kind allows siblings to swing together with the common supervision from the parent. Alternatively the swing seat may be arranged to have the seat portions arranged back-to-front, so that the safety seat is arranged in front, or back-to-back. In this case, the first and second seat portions are placed in front of each other, the parent and the child may be facing each other, which allows the parent and child to have eye contact. Eye contact between small children and parents is encouraged for a child's sense of security. By placing one seat portion behind the other, for instance the second seat portion behind the first seat portion, or the other way around, it may allow the parent to hold the child during swinging.

According to an embodiment of the swing seat, the second seat portion may be a regular seat.

With a second seat portion being a regular seat, it is meant a seat being substantially flat without supports surrounding the seat. The seat portion may be rectangular shaped or rounded, or any suitable shape so as to achieve a comfortable seat. The seat portion may also comprise a larger seat area to suit an adult or a big child. By providing the second seat portion with a regular seat it can allow for an adult or another child to swing along with the small child in the safety seat. The second seat portion may alternatively also be a safety seat in order to seat another small child. However, the second seat portion may be shaped to suit the purpose of the specific installation.

According to an embodiment of the swing seat, the swing seat can comprise a coupling bridge between the first and second seat.

The swing seat may be arranged such that the first and the second seat portions are coupled with a piece of material that forms a coupling bridge between the seat portions. The coupling bridge may be formed like a bridge with a center piece connecting the seat portions. Alternatively the coupling bridge may be formed as a frame or a partial frame having a piece of material on either or each side of the swing seat. By having a coupling bridge with a center piece, the center piece may form a third seat portion between the first and the second seat portions. By having a partial frame with a side piece, the coupling bridge may allow easy access for a user to sit on the second seat portion, as the user may not need to climb into the seat, but walk from the side. Also, it may allow a third seat on the side piece.

According to an embodiment of the swing seat, the swing seat further may comprise a third seat portion arranged in line with the first and the second seat portions.

In accordance with another aspect of the swing seat, the swing seat can allow for a number of seats to be arranged in line with each other, without consuming any additional space on the playground swing. The swing seat may also comprise more seat portions in line with each other. For instance, there may be a third seat portion arranged on the swing seat arranged for a third person, for instance another child.

The third seat portion may be arranged in between the first and the second seat portions, so that a parent may have full supervision over two children. Alternatively it may be arranged behind the first seat portion or behind the second seat portion, which ever may be suitable in the specific installation. The third seat portion may comprise a seating area adapted to provide a comfortable seating position for a bigger child or an adult.

According to an aspect of the swing seat, the third seat portion may constitute the coupling bridge.

The third seat portion may be arranged between the first and the second seat portions, such that the third seat portion and the coupling bridge may be formed from the same piece of material. In this way the coupling bridge may be used as a third seat portion, and may be adapted to suit this purpose. By using the coupling bridge between the first and the second seat portions as a third seat portion, a child may be seated on the third seat portion allowing a parent to have full supervision over two children. Also, with this arrangement, a child may sit with his/her back rested against the safety seat, or the other way around.

According to an embodiment of the swing seat, the first and second seat portions may be integrally manufactured from a single piece of material.

By having the seat portions be made from a single piece of material, any unnecessary joints may be avoided. According to yet another embodiment of the swing seat, the whole swing seat may be integrally manufactured from a single piece of material.

By having the seat portions or the whole swing seat manufactured from a single piece of material, any extra joints and couplings may be avoided. This may be an advantage since joints and couplings may involve an increased risk for accidents where children's clothes may be stuck in fastening elements used to in those couplings. Also by avoiding unnecessary joints or couplings, it may reduce the risk of failure of the equipment, and hence the need for expensive reparation or replacements may be reduced; and any unnecessary steps in assembling the swing seat may be avoided. The swing seat may be manufactured so as to allow the swing seat to be rigid but relatively light weight.

According to an embodiment of the swing seat, at least a first portion of the swing seat has a first material thickness, and a second portion of the swing seat has a second, thinner, material thickness, for constituting an impact deformation zone.

The swing seat may be manufactured such that it has different material thicknesses in different portions of the swing seat. This may provide suitable dampening to the swing seat such that it provides safety deformation zones in case of an impact. By allowing a swing seat to have variable material thicknesses, it may be possible to design the swing seat with suitable impact characteristics. For example, the first seat portion may require different impact characteristics than the second seat portion, since they may be suitable for users of different size and body weight. The first seat portion may thus be manufactured with a certain material thickness at for instance the back support, and another material thickness in the seat portion, whilst the second seat portion may constitute same material thickness overall. A further example may be that the safety seat may require a certain amount of dampening, since the safety seat may be specially designed for an infant which has less developed sense of balance.

In one embodiment an end portion of the first seat portion and an end portion of the second seat portion have a thinner material thickness than other portions of the swing seat portions, respectively. The end portions are to be read as being the portions of the swing seats portions that travel first/last in the swinging direction. Thereby, if the swing seat swings into an object or person, the material may dampen the impact between the swing and the object/person and thereby avoid or alleviate damage from an impact. However, any combination of material thicknesses is possible depending on requirements. It may also be possible that the swing seat is manufactured such that it may provide suitable impact dampening without any externally added dampening, such as for example glued-on or bolted-on foam. The swing seats may be dimensioned so as to provide strength such that the swing seat can safely withstand any weight of a user. The swing seat may further be designed to withstand extreme external forces that may occur on playgrounds where playground equipment may be exposed to rough treatment. The swing seat may alternatively be molded to be solid, or manufactured in some other suitable way. The material of each seat portion, or the whole swing seat, may be a polymer, rubber or a foam material. The material may be strong, yet flexible enough to provide a comfortable seat, but still have the strength to withstand the weight from its users.

According to an aspect of the swing seat, the swing seat further may comprise fastening points for attaching at least a first and a second suspension means. At least one of the first seat portion and the second seat portion may comprise a first and a second fastening point. Further, the other of the at least one of the first and the second seat portions may comprise at least a third fastening point. The first, second, and third fastening points may be arranged so as to prevent rotational movement of the swing seat around the longitudinal axis when suspended via the suspension means.

By having the swing seat supplied with fastening points, it enables the swing seat to be securely suspended in a playground swing. The swing seat may also be suspended in a tree or the like via suspension means in order to hang the swing seat. It is alternatively possible to mount the swing seat onto a different type of playground attraction, such as a roundabout or a merry go round, as well as a spring-type play unit, wherein a heavy duty vertical spring has a swing seat mounted on a top of the spring. The swing seat may also be mounted on several other types of playground equipment where suitable. The positioning of the fastening points on the swing seat may be depended on achieving a stable and balanced swing seat, which may vary depending on the specific installation. Also, due to the different weights that may be brought on the different seat portions, the balancing may be of high importance for delivering a safe and secure arrangement. In order to achieve a swing seat that may not tilt when in use, it may require being suspended in at least three points. For instance, the first seat portion may comprise a first and a second fastening point, located on either side of the longitudinal axis at a suitable distance from each other. The second seat portion may comprise a first fastening point, arranged so that the total balance of the swing seat is satisfactory and so the swing seat may not tilt regardless of how many users are on the swing seat. However, several fastening points for attaching suspension means may be provided in order to improve balance. In case a swing seat comprises a third seat portion, the fastening point for attaching a suspension means may be placed differently. For example, a third seat portion may comprise a first and a second fastening point, each arranged on a respective side of the third seat portion. Alternatively, the fastening points may be differently disposed over the swing seat suitable for the specific installation. It may be important that the fastening points are disposed on the swing seat so as to avoid it from turning over due to unsatisfactory suspension, since a child may fall out and hurt itself.

According to an aspect of the swing seat, the other of the at least one of the first and second seat portions further may comprise a fourth fastening point. The third and the fourth fastening points may be arranged at a distance from each other on a second axis. The third and the fourth fastening points may be arranged on a respective side of the longitudinal axis when seen from a Y-axis so as to prevent rotational movement of the swing seat around the longitudinal axis.

According to an aspect of the swing seat, the swing seat further comprises a fourth fastening point, wherein the first and the third fastening points may be arranged to be coupled to a first suspension means and the second and the fourth fastening points may be arranged to be coupled to a second suspension means.

The swing seat may be provided with a fourth fastening point for suspension. The fourth fastening point may be arranged on an opposite side of the longitudinal axis from the third fastening point. The third and the fourth fastening points may be placed so that in conjunction with the first and the second fastening points, a secure and balanced swing seat may be provided, so that tilting of the swing upon use may be avoided. The fastening points may each be attached to a suspension means in order to allow the swing seat to hang. For instance the first and the second fastening points, each may being placed on one and the same side of a user, may be attached to a first suspension means. The second and the fourth fastening points may each be placed on the second swing seat on the opposite side relative to the first and the third fastening points may be attached to a second suspension means. This may result in an arrangement with a first and a second suspension means, each arranged on a respective side of a user.

According to an aspect of the swing seat, the first and second axes may be perpendicular to the longitudinal axis when seen from a Y-axis. Further, the distance between the first fastening point and the longitudinal axis may be substantially the same as the distance between the second fastening point and the longitudinal axis. Moreover, the distance between the third fastening point and the longitudinal axis may be substantially the same as the distance between the fourth fastening point and the longitudinal axis.

By having fastening points arranged in this manner on the respective sides of the seat portions, a balanced arrangement may be achieved when in use and suspended in a suitable ways. It may facilitate the swing seat to swing in a general swinging direction, along the longitudinal axis. It is however possible to arrange fastening points differently, since the balance of the swing seat may be compensated for in different ways. For instance, a fastening point may be placed behind a seat portion for additional support.

According to an aspect of the swing seat, the swing seat is provided as a playground swing comprising a support structure. The support structure is adapted to be arranged on a base, and comprises an upper portion. Further, there is suspension means attached to the upper portion and at least one swing seat according to any of the above-mentioned embodiments attached to the suspension means.

A playground swing may comprise a support structure suitable for this type of swing seat. It may comprise a support arrangement, arranged in a substantially upright position to support a horizontal frame on an upper end. A horizontal bar may thus be supported upwards a distance from the ground by the support arrangement. The support arrangement may be substantially vertical, extending upwards so that a swing seat may be suspended from the horizontal bar in order to hang. Alternatively the support arrangement may constitute a pair of support members inclined towards each other for additional support. However, since the support member extends upwards, it may be substantially vertical for the purpose. The horizontal frame member may be arranged with installation points for one or more swing seats. A horizontal bar may thus comprise a first and a second mounting point for each swing seat that may be installed. The mounting points may each be arranged to suspend a swing seat via a suspension means in order to hold the swing seat and admit the swing seat to swing. A support arrangement may be shaped differently, as long as it suits a purpose to suspend a swing seat properly. The support arrangement may be round in shape, assembled such that one end around the radius is directed upwards.

According to an aspect of the swing seat, the horizontal frame member may comprise at least a first mounting point and a second mounting point. The first and second suspension means may be attached to the first and second mounting point respectively.

In order to provide a balanced swing, the swing seat may be suspended in the upper portion in at least one first mounting point. The support structure may further be provided with a second mounting point, to which a second suspension means may be attached. The mounting points may be arranged at a distance from each other so that the swing may be properly suspended and avoid the swing seat to spin around the suspension means. In order to arrange several swing seats along the horizontal frame member, several mounting points may be arranged.

According to an aspect of the swing seat, the suspension means may comprise a first suspension element extending from a first fastening point on the first seat portion to a first intersection point and a second suspension element extending from a third fastening point on the second seat portion to the first intersection point. Further, a second suspension means may comprise a first suspension element extending from a second fastening point on the first seat portion to a second intersection point and a second suspension element extending from a fourth fastening point on the second seat portion to the second intersection point.

The suspension means may be arranged in a number of ways. However it may be desired to arrange it in order to properly suspend the swing seat and keep the swing seat properly balanced in order to provide a secure swing seat for children. The suspension means may comprise several elements that each may support forces acting upon the swing seat from the weight of a user. The suspension elements and the swing seats may be dimensioned so as to provide strength that may safely withstand the weight of the user(s), and even extreme repetitive forces that may occur on playgrounds where playground equipment may be exposed to rough treatment. At least a part of the suspension elements may be arranged in a triangular shape, having a first and a second suspension element each secured to a respective fastening point on the swing seat, for instance the first and the third fastening points, and having the suspension elements joining in an intersection point. The suspension means may be arranged so that the intersection point coincides with the mounting point on the support structure. This would imply each suspension element to be of a length that comfortably fits the suspension means. The intersection point may alternatively be located so that the suspension means comprises a third suspension element with a suitable length extending from the intersection point to the mounting point. The lengths of each suspension element may be thoroughly calculated in order to achieve a well-balanced arrangement. A second suspension means substantially identical to the first suspension means may be arranged on the other side of the swing seat in a second and fourth fastening point, attached to the second mounting point of the horizontal frame member. The suspension means may be chain, wire, rope or the like, or a combination that may be suitable.

According to an aspect of the swing seat, the first and second intersection points are placed in connection to the first and second mounting point, respectively.

With the intersection point coinciding with the mounting point, it means that each of the suspension members extends the entire length of the suspension means. This may be an advantage since it may restrain the swing from tilting around an axis perpendicular to the longitudinal axis due to leverage that arises from the weight of the users.

According to an aspect of the swing seat, the first and second suspension means further may comprise a third suspension element extending from respective intersection point to the first and second mounting point respectively.

The intersection point may alternatively be located so that the each of the first and second suspension means may comprise a third suspension element with a suitable length extending from the intersection points to the mounting point. The lengths of each suspension element may be determined in order to achieve a well-balanced arrangement.

According to an aspect of the swing seat, the second suspension means may be substantially identical to the first suspension means and symmetrically arranged relative the first suspension means to the second and fourth fastening points of the swing seat.

The second suspension means may be substantially identical to the first suspension means. By having both suspension means identical, it may facilitate a symmetrically balanced swing arrangement. The second suspension means may be attached to a second mounting point in order to achieve a stable suspension. Alternatively, the second suspension means may be arranged so that it is attached to the first mounting point.

Further features of, and advantages with, the present invention will become apparent when studying the appended claims and the following description. The skilled addressee will realize that different features of the present invention may be combined to create embodiments other than those described in the following, without departing from the scope of the present invention.

BRIEF DESCRIPTION OF THE DRAWINGS

The invention will in the following be described in more detail with reference to the enclosed drawings, wherein.

DETAILED DESCRIPTION OF EMBODIMENTS

Figure 1:
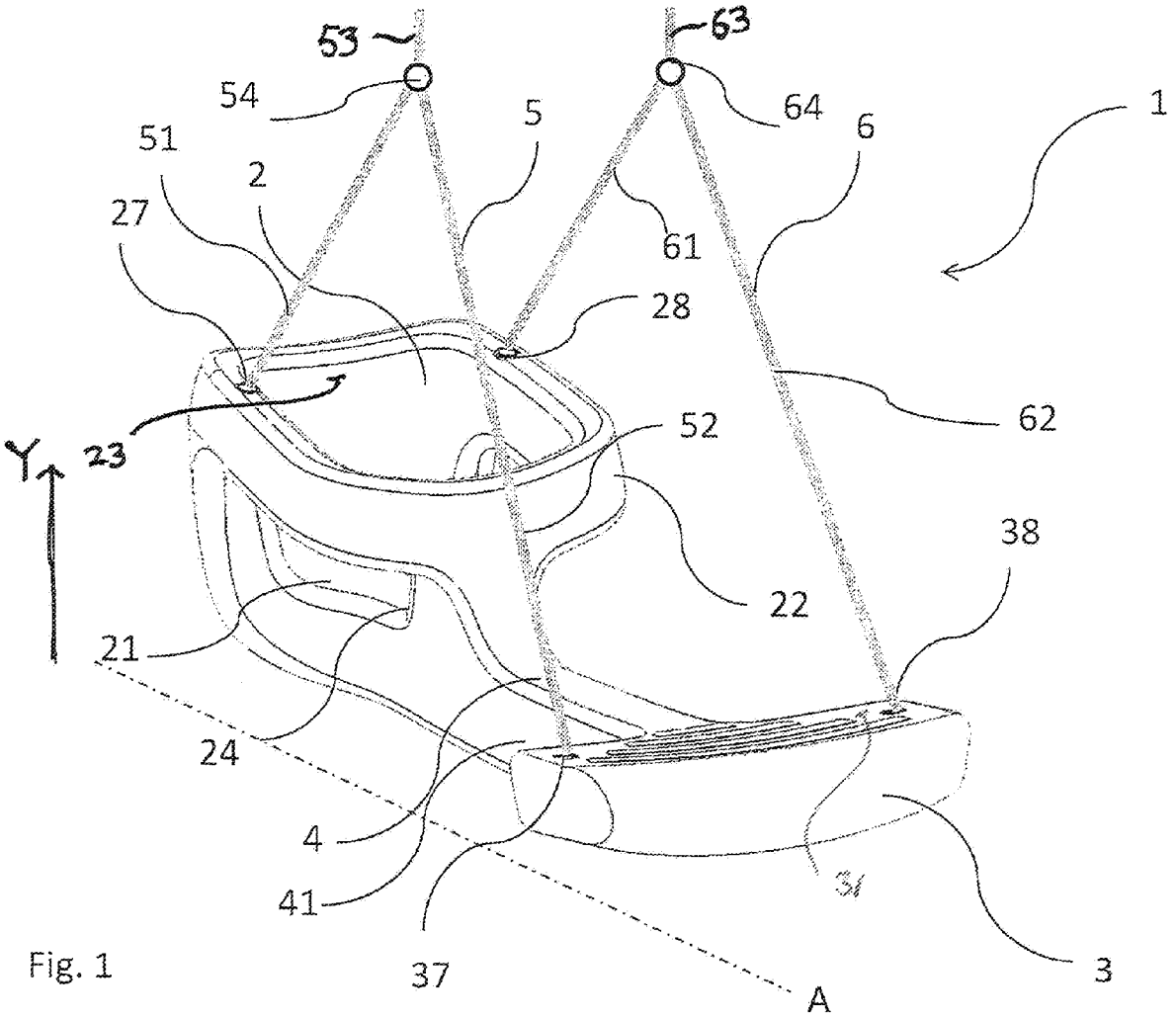
FIG. 1 is a perspective view of a swing seat according to an embodiment of the invention.

The present invention will be described more fully hereinafter with reference to the accompanying drawings, in which embodiments of the claimed invention are shown. This claimed invention may, however, be embodied in many different forms and should not be construed as limited to the embodiments set forth herein; rather, these embodiments are provided so that this disclosure will be thorough and complete, and will fully convey the scope of the claimed invention to those skilled in the art. In the drawings, like numbers refer to like elements.

The swing seat 1 is shown generally in FIG. 1. The swing seat's direction of travel is defined by a longitudinal axis A. Further when described as upwards and downwards and similar relative terms, it is with reference to the natural direction when the swing seat 1 is correctly mounted ready for use. It is understood that the relative directions are the same as when the swing seat 1 is in a dismounted condition. The swing seat 1 comprises a first seat portion 2, such as a safety seat 2 having a base portion 21 and a support frame 22. The safety seat 2 is arranged for an infant or a young child to be seated onto the base portion 21. The support frame 22 is arranged to hold the child in an upright position. The safety seat 2 is helpful if a child is too young to be able to keep its own balance in a safe way during swinging. The safety seat 2 further comprises a back support 23 and a leg dividing portion 24. The leg dividing portion 24 is arranged from the base portion 21 and upwards towards the support frame 22 so that a child can be seated with one leg on each side of the leg dividing portion 24. The leg dividing portion 24 prevents a child from sliding out of the safety seat 2. In FIG. 1, the leg dividing portion 24 is jointly connected and extends between the base portion 21 and the front part of the support frame 22, but it is possible that the leg dividing portion 24 is separate from the support frame 22. As shown in FIG. 1, the first seat portion 2 is arranged to be facing in a swinging direction, which coincides with the longitudinal axis A, which runs centrally through the base portion 21. The swing seat 1 further comprises a second seat portion 3. In FIG. 1, the second seat portion 3 is arranged in line with the first seat portion 2, along the longitudinal axis A. The second seat portion 3 is a regular seat, having a substantially flat seating area 31, and is adapted to suit an adult or a bigger child. The second seat portion 3 and the first seat portion 2 are joined through a coupling bridge 4. In FIG. 1, the coupling bridge 4 is seamlessly joining the base portion 21 and the seating area. The coupling bridge 4 is rigid, such that the distance between the first and second seat portions is substantially fixed, such that one seat portion does not move relative to the other during use of the swing seat. As shown in FIG. 1, the first seat portion 2 and the second seat portion 3 are arranged in line with each other. This allows a child and a parent to face each other when swinging. The first base portion 21, second seat portion 3 and the coupling bridge 4 may be level with each other such that they all lay substantially in the same plane, i.e., the first seat portion is neither significantly higher or lower than the second seat portion. Alternatively the seat portions can be arranged to be at suitable different levels to facilitate eye contact between the small child and a parent. For example, the first base portion 21 may be arranged at a plane higher up along the Y-axis relative the top surface of the second seat portion 3. Thereby, the small child's eyes in the safety seat may be closer in elevation to the eyes of the user of the second seat portion.

Further in FIG. 1, it is shown that the first and the second seat portions 2, 3 comprise fastening points 27, 28, 37, 38 for attaching suspension means 5, 6. Each fastening point is arranged so that the swing seat 1 is suitably balanced when in use. In FIG. 1, the fastening points 27, 28, 37, 38 are arranged mirrored on either side of the longitudinal axis A. The first seat portion 2 comprises first and second fastening points 27, 28 arranged on a first axis B at a distance from each other; and the second seat portion 3 comprises third and fourth fastening points 37, 38 arranged on a second axis C at a distance from each other. The fastening points 27, 28, 37, 38 may however be of any suitable number and placed anywhere in order to achieve a well-balanced swing seat. The swing seat 1 in FIG. 1 is suspended via a first suspension means 5 and a second suspension means 6, each attached at a respective fastening point on one side of the longitudinal axis A. This means that the first suspension means 5 is attached at the first 27 and the third 37 fastening points, and the second suspension means 6 is attached at the second 28 and the fourth 38 fastening points. The suspension means 5, 6 each comprise a number of suspension elements, which together form a stable suspension of the swing seat 1. In FIG. 1, the first and the second suspension means 5, 6 each comprise a first and a second suspension element 51, 52, 61, 62. The first and the second suspension elements 51, 52 are respectively attached in the first and the third fastening points 27, 28 and joined in an intersection point 54. In FIG. 1, there is a third suspension element 53 attached at the intersection point 54. In FIG. 1, the second suspension means is identical to the first suspension means, and includes a third suspension element 63 attached at the intersection point 64 of the suspension elements 61, 62.

Figure 2:
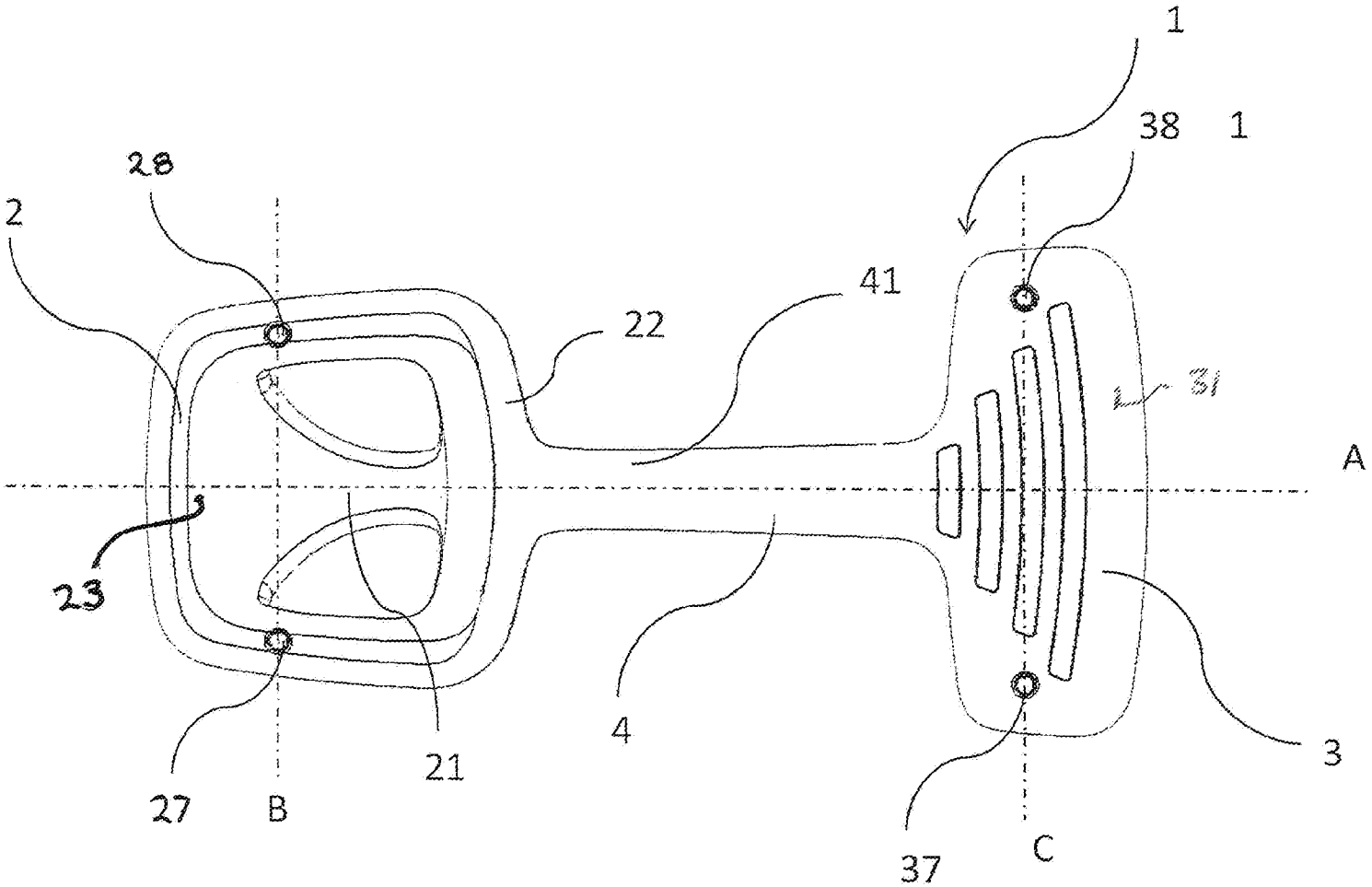
FIG. 2 is a top view of a swing seat according to an embodiment of the invention.

FIG. 2 shows a top view of the swing seat 1. In this figure, it is clear that the design of the swing seat 1 is mirrored on either side of, or symmetrical about, the longitudinal axis A, meaning that the longitudinal axis A extends through the center of the swing seat 1. Thus, the swing seat 1 is identical on either side of the longitudinal axis A in mirrored portions. In FIG. 2, the fastening points are arranged mirrored on either side of the longitudinal axis A when seen from the top view, i.e. from a direction along an Y-axis. The first seat portion 2 comprises first and second fastening points 27, 28 arranged on a first axis B at a distance from each other, the second seat portion 3 comprise third and fourth fastening points 37, 38 arranged on a second axis C at a distance from each other. FIG. 2 also shows that the fastening points of either seat portion is arranged along an axis perpendicular to the longitudinal axis A, at either side of the longitudinal axis A and at a similar distance from the longitudinal axis A. This arrangement is due to balancing of the swing seat 1 and to compensate for the weights brought onto the swing seat 1 when in use. In FIG. 2, the coupling bridge 4 is arranged and may comprise or define a third seat portion 4, in order to provide a comfortable seat. The third seat portion 4 may be suitably shaped. It may be entirely straight, round, rectangular or any other shape that may provide suitable function along with a comfortable seat.

Figure 3:
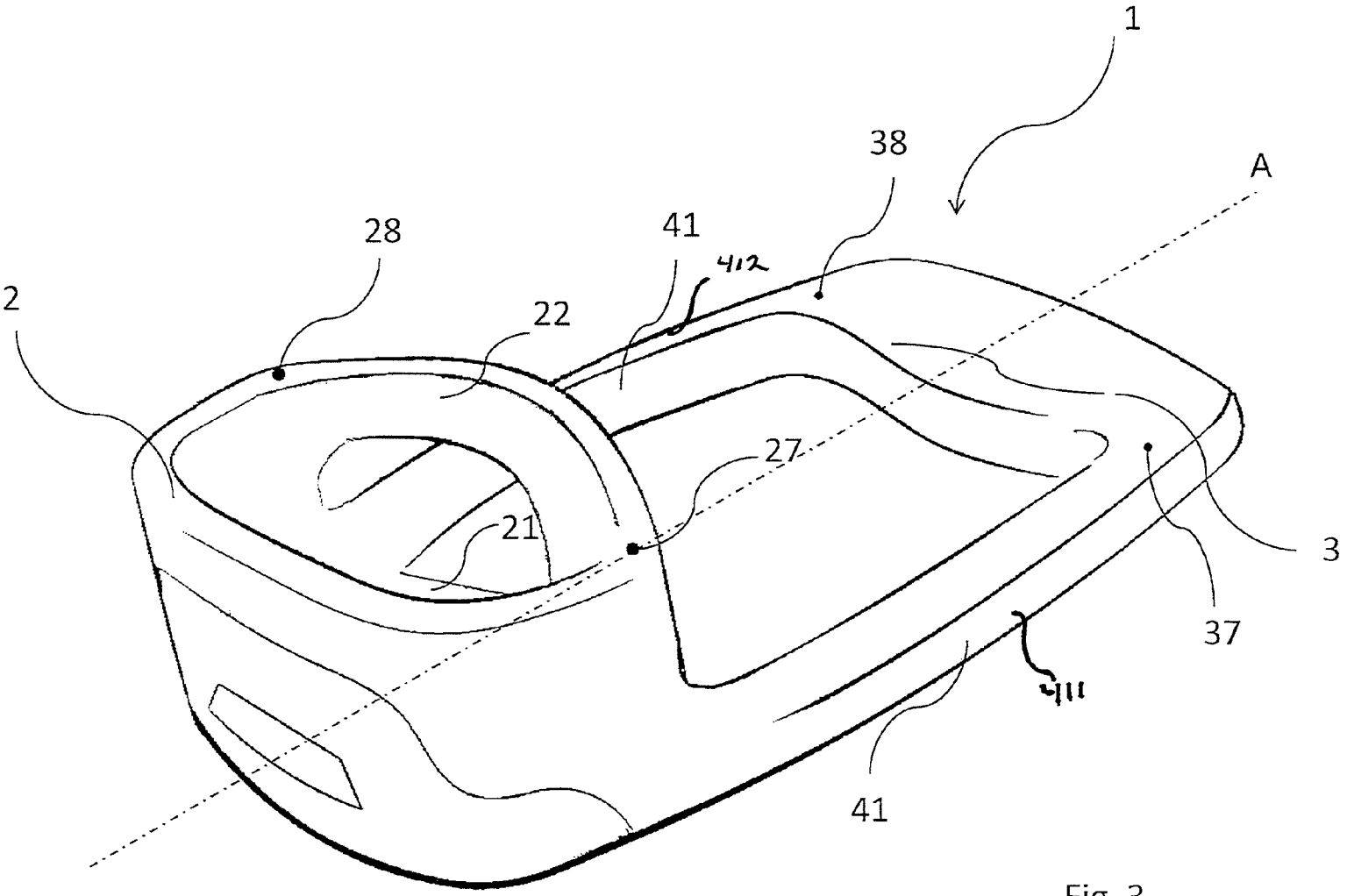
FIG. 3 is a perspective view of a swing seat according to an embodiment of the invention.

FIG. 3 shows a perspective view of an alternate embodiment of the swing seat 1. This swing seat 1 also comprises first and second seat portions 2, 3. The swing seat 1 in FIG. 3 also comprises a coupling bridge 41, in the shape of a frame having pieces of material on either side of the swing seat 1 to connect the first seat portion 2 and second seat portion 3. The coupling bridge 41 in FIG. 3 comprises two support bars 411, 412, forming a frame which connects the first and second seat portions. The support bars are arranged on either side of the longitudinal axis A and are substantially parallel with the longitudinal axis. However, it is also possible to have a swing seat where the coupling bridge only comprises one support bar connecting the first and second seat portions at one of their respective sides, which would facilitate a user getting on the second seat portion.

Figure 4:
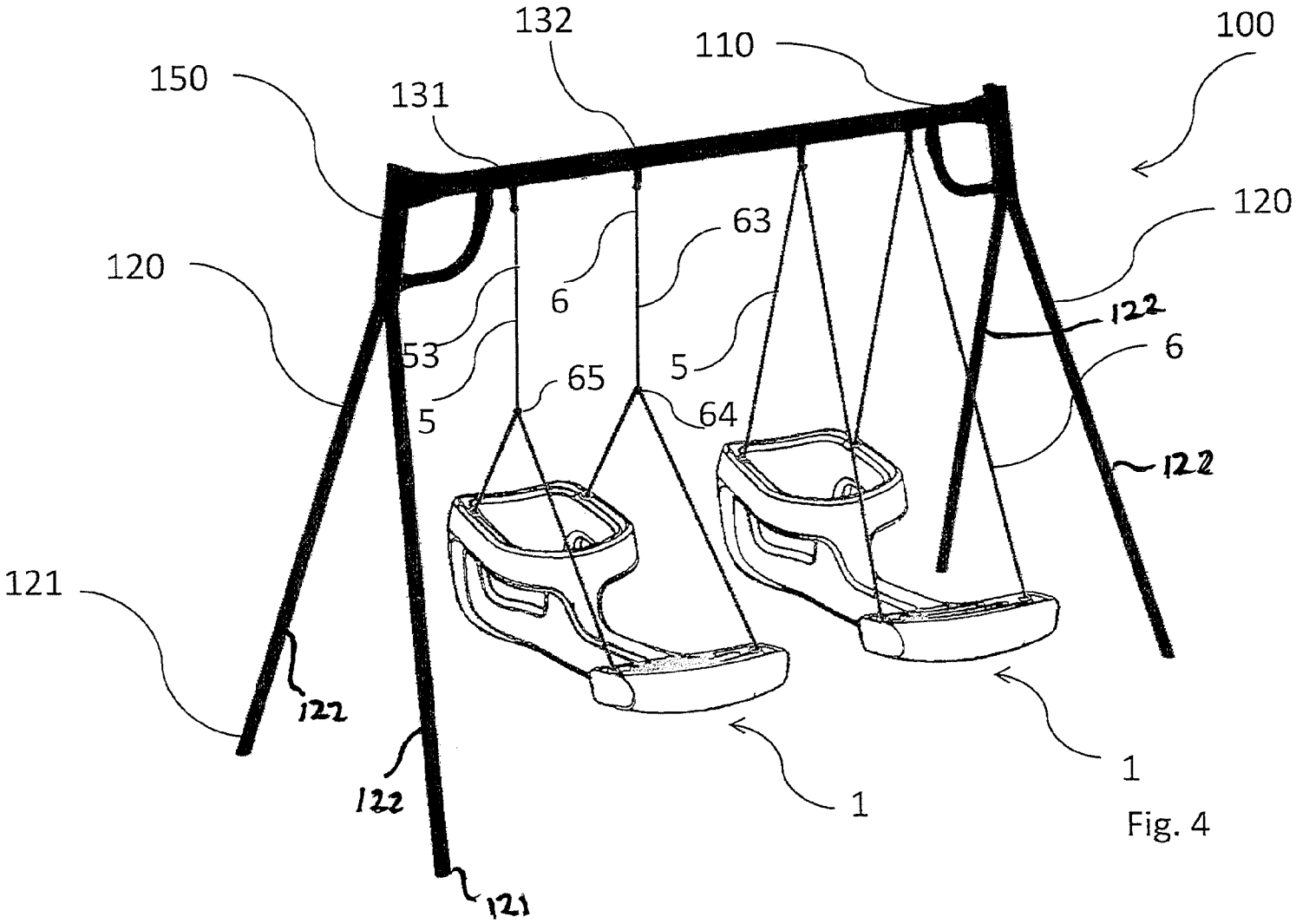
FIG. 4 is a perspective view of a playground swing according to an embodiment of the invention.

FIG. 4 shows a playground swing 100, wherein two swing seats 1 are mounted for use. The playground swing 100 comprises a support structure 150 having an upper portion 110 and two upright support arrangements 120. The upright support arrangement 120 is in the form of a vertical post and the upper portion 110 in FIG. 4 is a horizontal bar. The upright support arrangement 120 has a base end 121, which is shown in FIG. 4 as the lower end of the vertical post. The base end 121 is arranged on a base, floor or the ground, and is vertically arranged so as to support the upper portion 110. In FIG. 4 the upper portion 110 is in the shape of a horizontal bar, but it may be anything to which a swing seat 1 can be fastened. Each upright support arrangement 120 is arranged at either end of the horizontal bar 110. The horizontal bar comprises mounting points 131, 132 for attaching suspension means 5, 6.

Further, FIG. 4 shows the swing seat 1 having differently arranged suspension means. One swing seat 1 comprises suspension means 5, 6 having a third suspension element 53, 63 extending from the intersection point 54, 64 to the mounting points 131, 132. The other swing seat 1 comprises suspension means having a first and a second suspension means 5, 6 having their respective suspension elements extending directly from the fastening points 27, 28, 37, 38 to the respective mounting points 131, 132.

FIG. 4 shows a playground swing 100 wherein the upright support arrangements 120 each comprise two inclined upright support elements 122, with their respective base ends 121 arranged at a distance from each other, and the upper ends joined together. Also, a support structure 150 may be a tree or the like, and the upper portion 110 may be a tree branch or a ceiling, suitable for suspending the swing seat 1.

Although exemplary embodiments of the present invention have been shown and described, it will be apparent to one of skilled in the art that a number of changes and modifications, or alterations to the swing seat as described herein may be made. Thus, it is to be understood that the above description of the swing seat and the accompanying drawings is to be regarded as a non-limiting example thereof and that the scope of the invention is defined in the appended claims.

We claim:

1. A swing seat for a playground swing, wherein the swing seat extends along a longitudinal axis, said swing seat comprising:

a first seat portion; and a second seat portion coupled to said first seat portion, wherein the first seat portion is a child safety seat adapted to support a child too young to be able to keep its own balance in a safe way during swinging having a base portion for seating a child, a back support that at least partially extends from the base portion towards a support frame, and the support frame for supporting the child in an upright position, wherein the first seat portion is arranged to swing in a general swinging direction substantially coinciding with said longitudinal axis, and the second seat portion is arranged in line with the first seat portion along the longitudinal axis so that the first and the second seat portions are both aligned to swing in the general swinging direction.

2. The swing seat according to claim 1, wherein the first and second seat portions are arranged such that when in use, users of the first and second seats are facing each other.

3. The swing seat according to claim 1, wherein the second seat portion is a regular seat.

4. The swing seat according to claim 1, wherein the swing seat comprises a coupling bridge extending between the first and second seat, such that the distance between the first and second seat portions is substantially fixed, and such that one seat portion does not move relative to the other during use of the swing seat.

5. The swing seat according to claim 1, further comprising a third seat portion arranged in line with the first and the second seat portions.

6. The swing seat according to claim 5, wherein the third seat portion constitutes the coupling bridge.

7. The swing seat according to claim 1, wherein the first and second seat portions are integrally manufactured from a single piece of material.

8. The swing seat according to claim 1, wherein at least a first portion of the swing seat has a first material thickness, and a second portion of the swing seat has a second thinner material thickness, said second portion constituting an impact deformation zone.

9. The swing seat according to claim 1, further comprising fastening points for attaching at least a first and a second suspension means, wherein at least one of the first seat portion and the second seat portion comprises a first and a second fastening point, and the other one of said first seat portion and second seat portion comprises at least a third fastening point; wherein the first, second and third fastening points are arranged so as to prevent rotational movement of the swing seat around the longitudinal axis when suspended via the first and second suspension means.

10. The swing seat according to claim 9, wherein the swing seat further comprises a fourth fastening point, wherein the first and the third fastening points are arranged to be coupled to said first suspension means, and the second and the fourth fastening points are arranged to be coupled to said second suspension means.

11. A playground swing comprising:

at least one swing seat according to claim 1;

a support structure adapted to be arranged on a base and comprising an upper portion having a longitudinal direction, suspension means attached at a first end to the upper portion and at a second end to the at least one swing seat, wherein the at least one swing seat according to claim 1 is configured to swing in a swinging axis transverse to the longitudinal direction of the upper portion of the suspension means.

12. The playground swing according to claim 11, wherein the upper portion comprises at least a first mounting point and a second mounting point, and wherein the suspension means further comprises a first suspension means and a second suspension means and said first and second suspension means are attached to said first and second mounting point respectively.

13. The playground swing according to claim 12, wherein;

the first suspension means comprises a first suspension element extending from a first fastening point on the first seat portion to a first intersection point and a second suspension element extending from a third fastening point on the second seat portion to the first intersection point, and;

the second suspension means comprises a third suspension element extending from a second fastening point on the first seat portion to a second intersection point and a fourth suspension element extending from a fourth fastening point on the second seat portion to the second intersection point.

14. The playground swing according to claim 13, wherein each of the first and second suspension means further comprises a further suspension element extending from respective intersection point to the first and second mounting point respectively.

15. The playground swing according to claim 12, wherein the second suspension means is substantially identical to the first suspension means and symmetrically arranged relative the first suspension means.

16. The playground swing according to claim 11 wherein the at least one swing seat according to claim 1 further comprises at least two child safety seats each adapted to support a child too young to be able to keep its own balance in a safe way during swinging having a base portion for seating a child, a back support that at least partially extends from the base portion towards a support frame, and the support frame for supporting the child in an upright position.

17. The swing seat according to claim 1 wherein the child safety seat further comprises a waist frame surrounding the child around the waist and upper body of the child.

18. The swing seat according to claim 1 further comprising at least two child safety seats each adapted to support a child too young to be able to keep its own balance in a safe way during swinging having a base portion for seating a child, a back support that at least partially extends from the base portion towards a support frame, and the support frame for supporting the child in an upright position.

* * * * *